US007052045B2

(12) United States Patent
Park

(10) Patent No.: US 7,052,045 B2
(45) Date of Patent: May 30, 2006

(54) LABELING DEVICE FOR BOUND MATERIALS

(76) Inventor: Andy Park, 1220 Aberdeen Rd., Inverness, IL (US) 60067

( * ) Notice: Subject to any disclaimer, the term of this patent is extended or adjusted under 35 U.S.C. 154(b) by 46 days.

(21) Appl. No.: 10/401,373

(22) Filed: Mar. 28, 2003

(65) Prior Publication Data

US 2003/0213154 A1 Nov. 20, 2003

Related U.S. Application Data

(60) Provisional application No. 60/368,876, filed on Mar. 29, 2002.

(51) Int. Cl.
*B42D 3/00* (2006.01)

(52) U.S. Cl. ..... 281/36; 281/15.1; 281/28; 281/42; 281/45; 281/46; 281/47; 281/50; 402/79; 402/80 L; 402/80 P; 402/500; 24/3.7; 24/3.12; 24/11 CT; 24/67 R; 24/67.1; 24/67.3; 24/67.9; 24/439; 24/457; 24/545; 24/555; 24/556; 116/234; 116/236; 116/237; 116/238; 116/239; 40/642.02; 40/646; 40/649; 40/651; 40/652; 40/658; 40/661; 40/666

(58) Field of Classification Search ..... 281/15.1, 281/28, 42, 45, 46, 47, 50; 116/234, 236, 116/237, 238, 239; 40/642.02, 646, 649, 40/651, 652, 658, 661, 666; D19/34, 65; 24/67 R, 67.3, 67.9, 11 CT, 3.7, 3.12, 67.1, 24/439, 457, 545, 555, 556; 402/79, 80 L, 402/80 P, 500

See application file for complete search history.

(56) References Cited

U.S. PATENT DOCUMENTS

| | | | | |
|---|---|---|---|---|
| 1,843,542 | A | 2/1932 | Dawson | |
| 2,576,783 | A | 11/1951 | Dewey | |
| 2,846,795 | A * | 8/1958 | Balaban | 40/652 |
| 3,133,367 | A | 5/1964 | Rueppel | |
| 3,305,957 | A * | 2/1967 | Sobesky | 40/652 |
| 3,335,508 | A | 8/1967 | Hummel | |
| 3,335,510 | A | 8/1967 | Littler | |
| 4,001,957 | A * | 1/1977 | de Lima Castro | 40/661 |
| 4,596,482 | A | 6/1986 | Salzer | |
| 4,798,016 | A * | 1/1989 | Venditti et al. | 40/334 |
| 4,832,520 | A | 5/1989 | Artindale | |
| 5,443,029 | A * | 8/1995 | Garnet | 116/235 |
| 5,592,767 | A * | 1/1997 | Treske | 40/649 |
| 6,233,858 | B1 * | 5/2001 | Brach et al. | 40/660 |
| 6,481,367 | B1 * | 11/2002 | McClosky | 116/235 |
| 6,895,640 | B1 * | 5/2005 | Odaka | 24/11 R |
| 2002/0166497 | A1 * | 11/2002 | Rae | 116/237 |
| 2004/0045137 | A1 * | 3/2004 | Hsiao | 24/67.9 |

FOREIGN PATENT DOCUMENTS

GB 2195291 A * 4/1988

* cited by examiner

*Primary Examiner*—Boyer Ashley
*Assistant Examiner*—Mark Henderson
(74) *Attorney, Agent, or Firm*—Bell, Boyd & Lloyd LLC

(57) ABSTRACT

The present invention relates to an apparatus for labeling the spine or edge of a binder. In an embodiment, the device comprises a housing, a clip attached to the housing and a label encased within the housing. The housing further comprises a base portion and a cover portion, wherein the cover portion is adapted to enclose a label within the base portion of the labeling device.

15 Claims, 3 Drawing Sheets

LABELING DEVICE FOR BOUND MATERIALS

PRIORITY CLAIM

This application is a non-provisional application of, claims priority to, and the benefit of U.S. Provisional Application Ser. No. 60/368,876 filed on Mar. 29, 2002, the entire contents of which are incorporated herein.

BACKGROUND OF THE INVENTION

The present invention generally relates to labeling devices, and more particularly relates to labeling devices used to label the spine or edge of a binder.

Comb-type and coil-type binding elements are commonly used to bind materials together for low-volume binding applications. Comb-type binders include a spine having a plurality of curled, spaced fingers integral with the edge of the spine at one end, and free at the other end. The free end of the fingers are fed through apertures in the materials to be bound and curl to rest resiliently against the opposite edge of the spine.

Coil-type or spiral binders are composed of a continuous coil which is fed through a series of spaced holes along the edge of a stack of materials to be bound.

Materials bound by the methods described above are generally thinner than materials bound using traditional book binding methods, making the spine of such materials difficult to label. Further, because coil-type binders do not contain a spine, it is particularly difficult to label the edge of such binders.

Prior devices developed to label the spine of comb-type binders had to be sized to fit the exact width of the binder, or required complicated installation.

For the above and other reasons, a need still exists to provide an improved device for labeling bound materials.

SUMMARY OF THE INVENTION

The present invention relates to an apparatus for labeling the spine or edge of a binder. The labeling device for labeling bound materials includes a reclosable housing, a clip attached to the housing, and a label encased within the housing.

The housing of the labeling device further includes a base portion and a cover portion attached to the base portion of the housing. The base portion of the housing defines a channel wherein the channel is adapted to receive a label. The cover portion is adapted to enclose a label in the base portion of the housing.

The cover portion is made of a transparent material to reveal the contents of the label therethrough, and may be made from the same material or a different material that the other components of the labeling device. In an embodiment, the cover portion is made of a transparent polypropylene. In further embodiments, the cover portion may be made of transparent polyethylene, or a transparent blend of polypropylene and polyethylene.

The clip portion of the labeling device is adapted to receive the spine or edge of a binder and is flexibly attached to the base portion of the housing. In an embodiment, the clip portion and the housing are manufactured as one integral piece of flexible material. In a further embodiment, the clip portion is attached to the housing by a spring loaded member. The clip portion may be made of any suitable materials such as metals, plastics and the like.

The labeling device of the present invention may be made of any suitable material. In an embodiment, the labeling device is made of polypropylene. In further embodiments, the labeling device may be made of polyethylene, or a blend of polypropylene and polyethylene.

The labeling device may be made of colored materials to further aid in organizing and classifying materials.

The present invention also relates to a method of labeling a binder including the steps of: providing a labeling device comprising a recloseable housing, a clip attached to the reclosable housing, and a label encased within the housing; and attaching the labeling device to the spine or edge of a binder.

It is therefore an advantage of the present invention to provide a labeling device suitable for labeling variously sized binders.

Another advantage of the present invention is to provide a labeling device that can easily be attached to, and removed from the spine or edge of a binder.

Additional features and advantages of the present invention are described in, and will be apparent from, the following Detailed Description of the Invention and the figures.

DETAILED DESCRIPTION OF THE INVENTION

Figure 1:
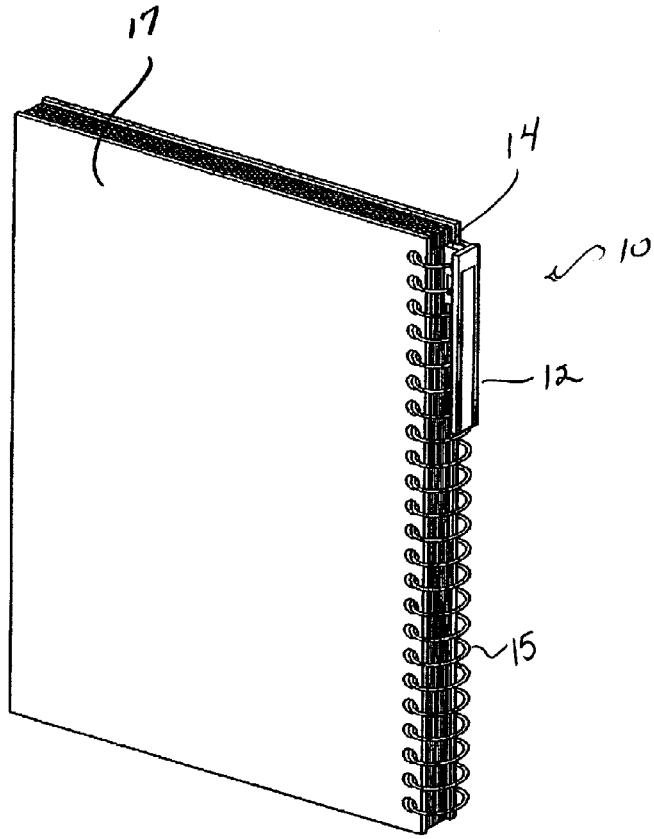
FIG. 1 is a perspective view of an embodiment of the binder clip of the present invention shown attached to the edge of a spiral binder.

The present invention relates to an apparatus for labeling the spine or edge of a binder. The labeling device of the present invention provides a detachable labeling system for use with various types of binders. The term "binder" as used herein refers to any device used for securing paper or other materials such as coil binders, comb-type binders, loop wire binders, twin loop binders and the like.

One embodiment of the labeling device according to the present invention is shown in FIGS. 1 to 5 and is generally indicated by numeral 10. The labeling device 10 includes a housing 12 for encasing a label 28 and a clip 14 for attaching the labeling device 10 to the spine or edge 15 of a binder 17.

FIG. 1 illustrates an example of the labeling device 10 of the present invention attached to a set of materials bound with a spiral or coil-type binder 17. The housing 12 of the labeling device 10 encloses a label 28 and is attached to the edge of the binder 17 by means of a clip 14 attached to the upper rear portion of the housing 12.

Figure 2:
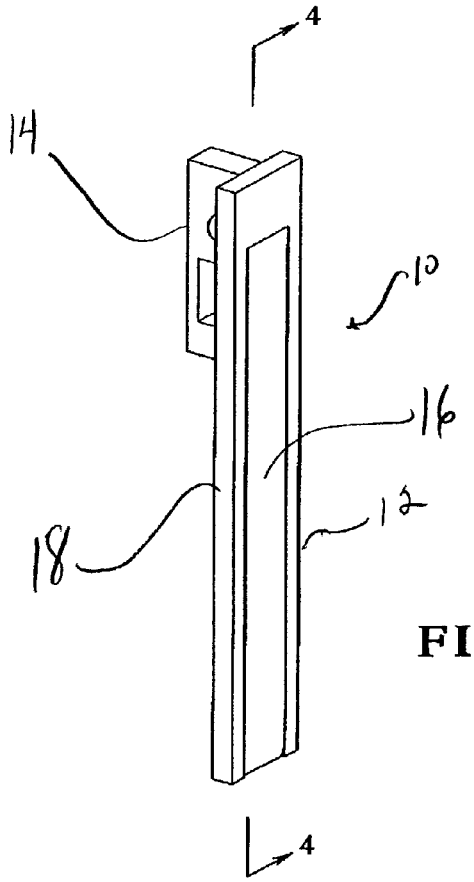
FIG. 2 is a perspective view of an embodiment of the binder clip of the present invention.

Turning now to FIG. 2, a perspective view of the labeling device 10 further illustrates the example of the labeling device 10 depicted in FIG. 1. The housing 12 of the labeling device 10 contains a cover portion 16 and a base portion 18 attached at the upper back end to the clip portion 14. The cover portion 16 of the housing 12 is made of a transparent material to show the contents of a label 28 (See FIG. 5) therethrough.

Figure 3:
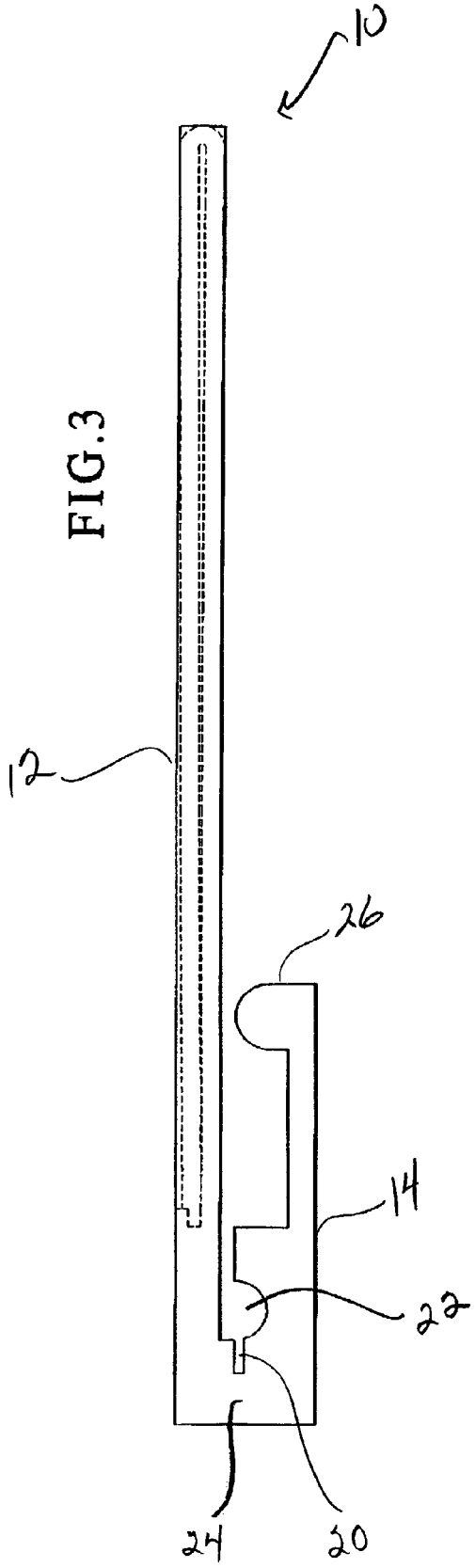
FIG. 3 is a side view of an embodiment of the binder clip of the present invention.

Turning now to FIG. 3, the clip portion 14 of the labeling device 10 is shown in greater detail. The clip 14 defines a first recessed portion 20 and a second recessed portion 22. The first recessed portion 20, defining a rectangular slit, is configured to accommodate the flat spine portion of a comb-type binder. The second recessed portion 22, defining a semi-circular region, is configured to accommodate the curved portion of a coil or spiral binder. While the clip portion 14 of this embodiment of the labeling device is particularly configured to be attached to coil or comb-type binders, it should be appreciated that the labeling device of the present invention may be used in conjunction with any binder having a spine with sufficient space to accommodate the clip portion of the labeling device.

The clip portion 14 of the labeling device 10 is attached to the housing 12 such that when the clip portion 14 is extended outward from its bottom end 26, there is sufficient resiliency for the clip portion 14 to return to its starting position. The clip portion 14 may be configured in various ways to achieve the desired resiliency. In the embodiment shown in FIG. 3, the clip portion 14 and the housing 12 of the labeling device are designed as an integral unit, connected by a segment of material 24. In this embodiment, the labeling device is manufactured from a material which provides sufficient strength and resiliency to withstand repeated bending without breaking or losing its shape. Alternatively, the clip portion 14 and housing 12 may be separately manufactured and assembled.

In an embodiment, the clip portion 14 is attached to the housing 12 by means of a spring loaded member (not shown). In this embodiment, the clip portion 14 is in the form of a "spring clip" which provides excellent resiliency and a secure fit to the spine of a binder.

Figure 5:
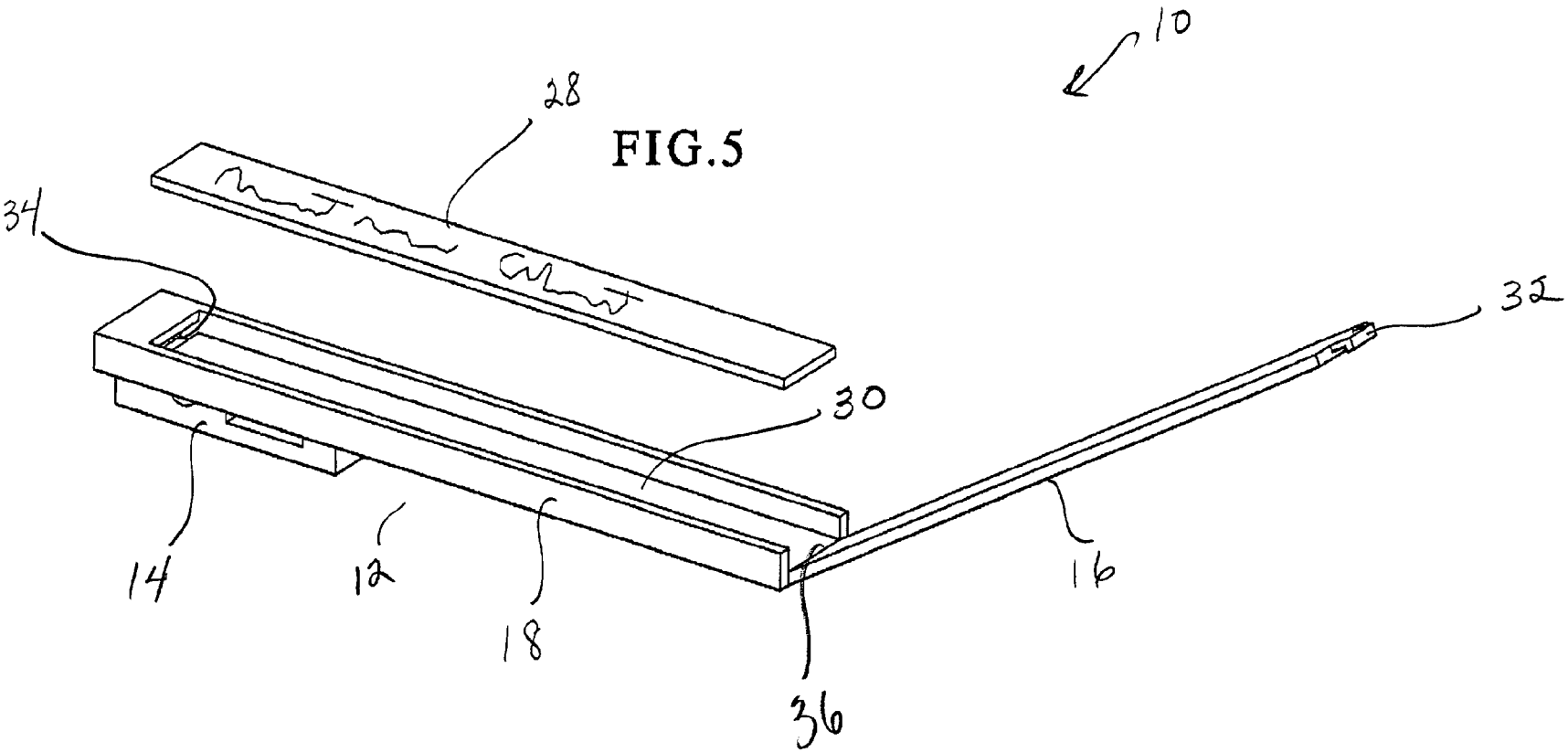
FIG. 5 is a perspective view of an embodiment of the binder clip shown with the cover portion in an open position.

Turning now to FIG. 5, the housing 12 is shown with the cover portion 16 in an open position, showing how a label 28 is placed within the inner cavity or channel 30 defined by the base portion of the housing 18. In an embodiment, the cover portion 16 of the housing 12 is hingedly attached to the base portion 18 of the housing 12 by a segment of material 36.

The cover portion of the housing 16 is made of a transparent material which may be the same material, or a different material than that used for the base portion of the housing 18 and the clip 14. The cover portion 16 may be made of any suitable transparent material. In an embodiment, the cover portion 16 is made of polypropylene. In further embodiments, the cover portion 16 may be made of transparent polyethylene, or a transparent blend of polypropylene and polyethylene.

Figure 4:
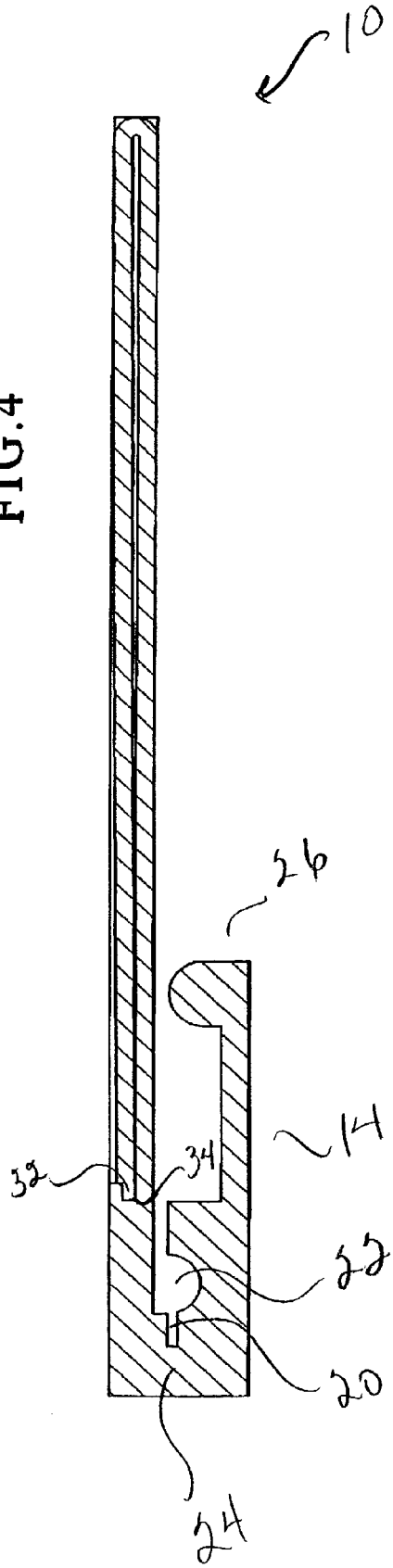
FIG. 4 is a cross-sectional view of the binder clip of FIG. 2, taken along line 4—4.

In an embodiment, the cover portion 16 of the housing 12 is configured with a tab 32 at its free end designed to cooperate with a corresponding slot 34 in the inner cavity 30 of the housing. Turning now to FIG. 4, tab 32 is shown engaged in slot 34.

In an alternate embodiment of the invention, the cover portion 16 of the housing 12 slides over the top portion of the channel 30 (not shown). In a further embodiment, the housing has no cover portion, and the channel 30 is configured to hold a label in place (not shown).

The labeling device 10 may be made of a variety of suitable materials such as plastics, metal, and the like. The labeling device 10 may be made in a variety of colors to further aid in classifying materials. In an embodiment, the labeling device 10 is made of polypropylene. In a further embodiment, the labeling device may be made of polyethylene, or a blend of polypropylene and polyethylene. In yet another embodiment, the clip 14 of the labeling device is made of metal and the housing 12 is made of a plastic material such as polypropylene, polyethylene, or a blend of polypropylene and polyethylene.

The labeling device 10 may variously sized to fit a variety of binder types. In an embodiment, the cover portion 16 of the labeling device 10 measures about 3.5" by 0.25".

To utilize the labeling device 10 of the present invention, a label 28 is placed inside the channel 30 of the base portion 18 of the housing 12, and the tab 32 at the end of the cover portion 16 of the housing 12 is inserted in slot 34 to secure the cover portion 16 over the label 28. Once the label is in place, the labeling device is placed on the spine or edge 15 of a binder 17 by extending the clip portion 14 from the bottom end 26 and engaging the spine or edge 15 of the binder 17 with the first or second recessed portions (20, 22) of the clip 14. The first recessed portion 20 is adapted to receive the spine of a comb-type binder (not shown), and the second recessed portion 22 is adapted to receive a coiled segment of a spiral binder 17.

The labeling device of the present invention is easily attached to, and removed from the spine or edge of a binder, making the device convenient to use, as well as reusable.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A labeling device for labeling a binder comprising:

a reclosable housing including a base portion and a cover portion, wherein the cover portion of the housing is hingedly attached to the base portion of the housing, a clip attached to the housing, wherein the clip includes a first recessed portion defining a substantially rectangular slit and a second recessed portion defining a substantially semi-circular region, and a label encased within the housing.

2. The device of claim 1, wherein the first recessed portion is adapted to receive a spine or edge of a comb-type binder and the second recessed portion is adapted to receive a curved portion of a coil or spiral binder.

3. The device of claim 1, wherein the clip is attached to the housing by a spring loaded member.

4. The device of claim 1, wherein the base portion defines a channel wherein said channel is adapted to receive a label.

5. The device of claim 1, wherein the device is made of a material taken from the group consisting of polypropylene, polyethylene, and mixtures thereof.

6. The device of claim 4, wherein the cover portion is adapted to enclose the label in the base portion of the housing.

7. The device of claim 6, wherein the cover portion is made of a transparent material.

8. A method of labeling a binder comprising:

providing a labeling device comprising a recloseable housing including a base portion and a cover portion, wherein the cover portion of the housing is hingedly attached to the base portion of the housing, a clip attached to the reclosable housing, wherein the clip includes a first recessed portion defining a substantially rectangular slit and a second recessed portion defining a substantially semi-circular region, and a label encased within the housing; and attaching the labeling device to a spine of the binder.

9. The method of claim 8, wherein the clip is attached to the housing by a spring loaded member.

10. The method of claim 8, wherein the base portion defines a channel, and wherein said channel is adapted to receive a label.

11. The method of claim 8, wherein the device is made of a material taken from the group consisting of polypropylene, polyethylene, and mixtures thereof.

12. The method of claim 10, wherein the cover portion is adapted to enclose the label in the base portion of the housing.

13. The method of claim 12, wherein the cover portion is made of a transparent material.

14. A device for labeling a binder comprising:

a housing including a base portion and a cover portion, wherein the cover portion of the housing is hingedly attached to the base portion of the housing;

a clip attached to the housing, wherein the clip includes a first recessed portion defining a substantially rectangular slit and a second recessed portion defining a substantially semi-circular region; and a label encased within the housing.

15. The device of claim 14, wherein the base portion of the device is adapted to receive a label and the cover portion is adapted to enclose the label in the base portion.

* * * * *